US008876236B2

(12) United States Patent
Kondo et al.

(10) Patent No.: US 8,876,236 B2
(45) Date of Patent: Nov. 4, 2014

(54) LIQUID JETTING APPARATUS

(75) Inventors: Hirofumi Kondo, Tajimi (JP); Yasuhiro Kato, Nagoya (JP); Masayoshi Hayashi, Nagoya (JP); Tatsuya Nishikawa, Nagoya (JP); Reiko Higashikawa, Iwakura (JP); Toru Yamashita, Nagoya (JP); Masato Sueyasu, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 407 days.

(21) Appl. No.: 13/431,819

(22) Filed: Mar. 27, 2012

(65) Prior Publication Data

US 2013/0083102 A1 Apr. 4, 2013

(30) Foreign Application Priority Data

Sep. 30, 2011 (JP) ..... 2011-217376

(51) Int. Cl.
*B41J 29/38* (2006.01)
*B41J 2/14* (2006.01)
*B41J 2/175* (2006.01)

(52) U.S. Cl.
CPC ..... *B41J 2/14209* (2013.01); *B41J 2/17509* (2013.01); *B41J 2002/14491* (2013.01); *B41J 2/175* (2013.01); *B41J 2202/18* (2013.01)
USPC ..... 347/9

(58) Field of Classification Search
None
See application file for complete search history.

(56) References Cited

U.S. PATENT DOCUMENTS

| | | | |
|---|---|---|---|
| 2005/0024419 | A1 | 2/2005 | Furukawa |
| 2006/0256152 | A1 | 11/2006 | Furukawa |
| 2010/0097428 | A1 | 4/2010 | Owaki |

FOREIGN PATENT DOCUMENTS

| | | | |
|---|---|---|---|
| JP | 2003-145758 | A | 5/2003 |
| JP | 2003-247057 | A | 9/2003 |
| JP | 2005-047093 | A | 2/2005 |
| JP | 2005-254546 | A | 9/2005 |
| JP | 2006-231584 | A | 9/2006 |
| JP | 2007-030417 | A | 2/2007 |
| JP | 2010-099872 | A | 5/2010 |
| JP | 2010-143084 | A | 7/2010 |

*Primary Examiner* — Geoffrey Mruk
*Assistant Examiner* — Bradley Thies
(74) *Attorney, Agent, or Firm* — Merchant & Gould PC

(57) ABSTRACT

A liquid jetting apparatus includes: a liquid jetting head in which nozzles for jetting the liquid are formed and which has an actuator for jetting the liquid from the nozzles; an interposer substrate which is provided to the liquid jetting head and on which a driver IC is mounted; a control substrate which controls the liquid jetting head; a wire member which connects the interposer substrate and the control substrate; and a flexible circuit board which connects the interposer substrate and the actuator, wherein the interposer substrate has a first connecting portion to which the wire member is to be connected, and a second connecting portion to which the flexible circuit board is to be connected, and the driver IC is arranged nearer to the first connecting portion than the second connecting portion of the interposer substrate.

9 Claims, 8 Drawing Sheets

LIQUID JETTING APPARATUS

CROSS REFERENCE TO RELATED APPLICATION

The present application claims priority from Japanese Patent Application No. 2011-217376, filed on Sep. 30, 2011, the disclosure of which is incorporated herein by reference in its entirety.

BACKGROUND OF THE INVENTION

1. Field of the Invention

The present invention relates to a liquid jetting apparatus which jets a liquid from nozzles.

2. Description of the Related Art

As a liquid jetting apparatus which jets a liquid from nozzles, a recording apparatus which jets an ink from a nozzle which communicates with a pressure generating chamber by applying a pressure to the ink in the pressure generating chamber by a vibrator unit has been described in Japanese patent Application Laid-open Publication No. 2006-231584. In this recording apparatus, the vibrator unit is connected to a head substrate which is arranged at an upper side of a recording head, via a flexible circuit board. Moreover, the vibrator unit is driven by sending a driving signal which is generated in a driving circuit (driver IC) mounted on the head substrate, to the vibrator unit via the flexible circuit board.

Here, in the recording apparatus described in Japanese Patent Application Laid-open Publication No. 2006-231584, since the driving circuit is mounted on the head substrate which is located at a position comparatively nearer from the vibrator unit, the heat generated in the driving circuit is susceptible to be transmitted to the vibrator circuit via the flexible circuit board. As a result, there is a possibility that due to the heat transmitted from the driver IC, driving characteristics of the vibrator unit, or in other words, jetting characteristics of the ink from the nozzle fluctuate.

SUMMARY OF THE INVENTION

An object of the present invention is to provide a liquid jetting apparatus in which the heat generated in the driver IC is hardly transmitted to an actuator.

According to an aspect of the present invention, there is provided a liquid jetting apparatus which jets a liquid, including: a liquid jetting head in which nozzles for jetting the liquid are formed and which has an actuator for jetting the liquid from the nozzles; an interposer substrate which is provided to the liquid jetting head and on which a driver IC is mounted; a control substrate which controls the liquid jetting head; a wire member which connects the interposer substrate and the control substrate; and a flexible circuit board which connects the interposer substrate and the actuator, wherein the interposer substrate has a first connecting portion to which the wire member is to be connected, and a second connecting portion to which the flexible circuit board is to be connected, the driver IC is arranged nearer to the first connecting portion than the second connecting portion of the interposer substrate, and a penetrating portion which penetrates the interposer substrate in a thickness direction of the interposer substrate or a notch is formed in the interposer substrate, so that the penetrating portion or the notch is arranged on a virtual line which is drawn by connecting any portion of the driver IC and any portion of the second connecting portion.

According to the aspect of the present invention, since the driver IC is arranged at the position nearer to the first connecting portion than the second connecting portion of the interposer substrate, a substantial amount of heat generated by the driver IC by driving is transmitted more toward the wire member than toward the circuit board. Furthermore, since the penetrating portion or the notch is formed so that the penetrating portion or the notch is arranged on the line connecting the driver IC and the second connecting portion, the heat generated in the driver IC is escaped from the interposer substrate while being transmitted upon circumventing around the through portion. Accordingly, the heat generated in the driver IC is hardly transmitted to the actuator which is connected to the interposer substrate.

Furthermore, since the driver IC is arranged at the position nearer to the first connecting portion than the second connecting portion of the interposer substrate, on the interposer substrate, it is possible to shorten a wire length of a power supply line by shortening a distance between the driver IC and the first connecting portion which is connected to the control substrate via the wire member. Moreover, a space for drawing around the wiring pattern which connects the driver IC and the second terminals and transmits a driving signal increases, and drawing around of the wiring pattern becomes easy.

DESCRIPTION OF THE PREFERRED EMBODIMENTS

An exemplary embodiment, and modified embodiments of the present teaching will be described below.

Figure 1:
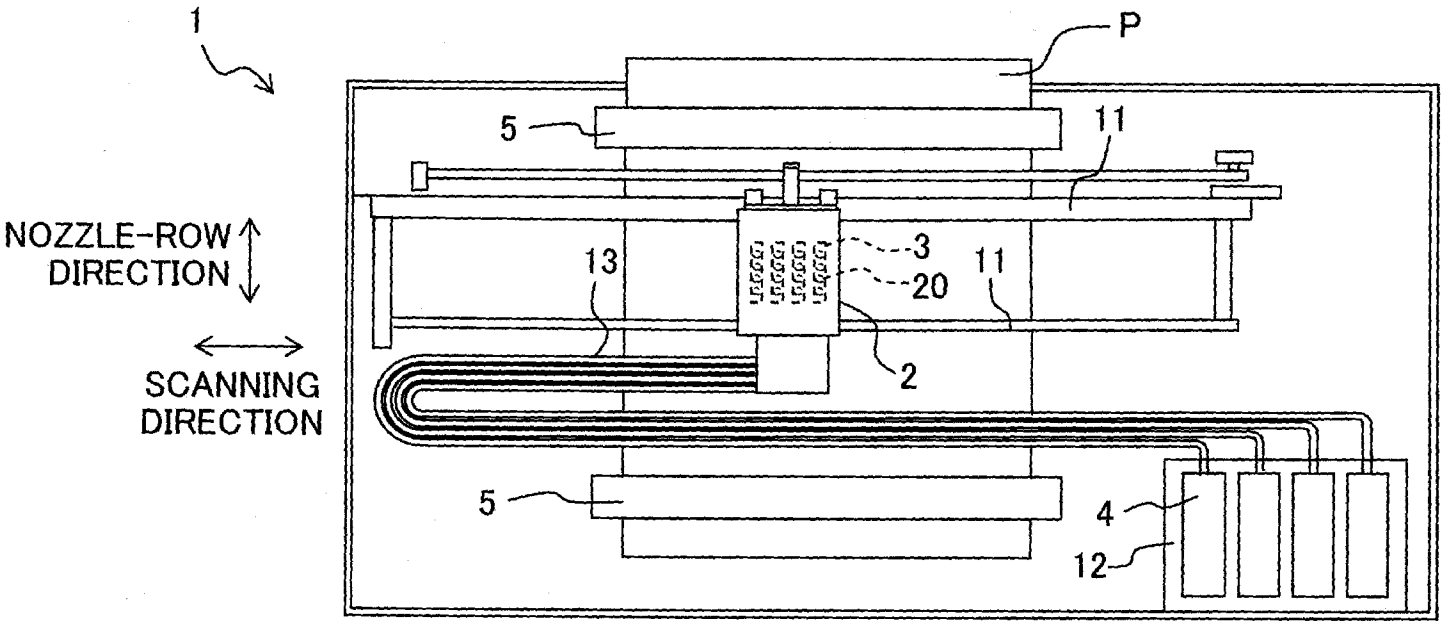
FIG. 1 is a schematic structural view of a printer according to an embodiment of the present teaching.

As shown in FIG. 1, printer 1 (liquid jetting apparatus) according to an embodiment of the present teaching includes a carriage 2, an ink jet head 3, an ink cartridge 4, and a paper transporting roller 5.

The carriage 2 reciprocates in a scanning direction (left-right direction in FIG. 1) along guide rails 11. Four ink jet heads 3 (liquid jetting heads) are mounted on the carriage 2, and arranged in a row along the scanning direction. The ink-jet head 3 jets an ink from a plurality of nozzles 20 formed on a lower surface thereof. More elaborately, the four ink-jet heads 3 jet inks of colors namely, yellow, cyan, magenta, and black in order from the ink-jet head arranged on a left side in FIG. 1. The plurality of nozzles 20 formed in each ink jet head 3 is aligned in the nozzle-row direction (vertical direction in FIG. 1) orthogonal to the scanning direction.

Four ink jet cartridges 4 are installed on a cartridge installing portion 12, and are connected to the four ink-jet heads 3 respectively, via tubes 13, supply holes 42*c* which will be described later, and tubes 36 which will be described later. The four ink cartridges 4 installed on the cartridge installing portion 12 are arranged in a row along the scanning direction, and inks of four colors namely, yellow, cyan, magenta, and black are stored in order from the ink cartridge which is arranged on a left side in FIG. 1, in these four ink cartridges 4. Inks of colors corresponding to the four ink jet heads 3 are supplied from the four ink cartridges 4.

The paper transporting roller 5 is driven by a motor which is not shown in the diagram, and transports a recording paper P in a downward direction in FIG. 1, which is parallel to the nozzle-row direction.

Moreover, in the printer 1, printing is carried out on the recording paper P which is transported parallel to the nozzle-row direction by the paper transporting roller 5, by jetting inks of four colors from the ink-jet heads 3 reciprocating in the scanning direction along with the carriage 2.

Figure 2:
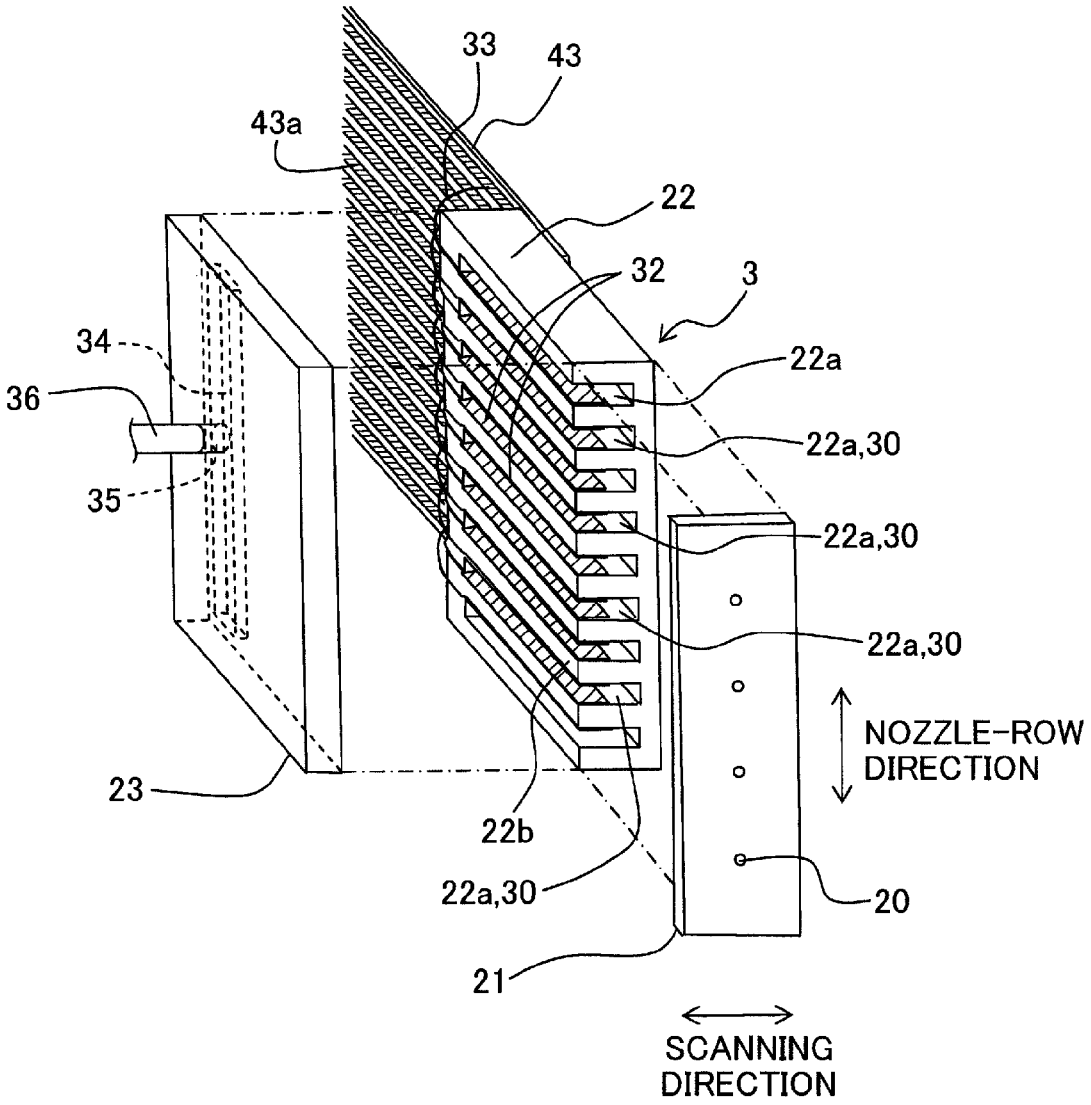
FIG. 2 is an exploded perspective view of a structure of an ink jet head in FIG. 1.

Next, a structure of the ink-jet head 3 and an area around the ink-jet head 3 will be described below in detail. The ink jet head 3, as shown in FIG. 2, includes a nozzle plate 21, a piezoelectric plate 22, and a cover plate 23.

The nozzle plate 21 is a plate made of a synthetic resin material in which the plurality of nozzles 20 are formed along the nozzle-row direction. The piezoelectric plate 22 is made of a piezoelectric material which is composed of mainly lead zirconium titanate (PZT) which is a mixed crystal of lead titanate and lead zirconate, and is arranged on an upper surface of the nozzle plate 21.

A plurality of grooves 22*a* which are in odd number is formed on the piezoelectric plate 22. Each of the plurality of grooves 22*a* opens on an end surface (edge surface) on one side with respect to the scanning direction, and extends in a vertical direction. The plurality of grooves 22*a* are aligned along the nozzle-row direction. Moreover, from among the plurality of grooves 22*a*, the grooves 22*a* which are arranged at even-numbered positions with respect to the nozzle-row direction function as pressure chambers 30.

The plurality of grooves 22*a* extend up to a lower surface of the piezoelectric plate 22 which is to be joined to the nozzle plate 21, where lower ends of the plurality of grooves 22*a* open. Accordingly, each pressure chamber 30 communicates with the corresponding nozzle 20. Furthermore, a plurality of electrodes 32 are formed in the piezoelectric plate 22. The plurality of electrodes 32 are formed on wall portions 22*b* which are walls on both sides with respect to the nozzle-row direction of each pressure chamber 30 such that the electrodes 32 sandwich the wall portions 22*b* respectively from the nozzle-row direction. A wire 33 is connected to each of the plurality of electrodes 32, and the wire 33 is drawn to an exterior of the ink-jet head 3.

The cover plate 23 is joined to the piezoelectric plate 22 to cover the openings, on one side with respect to the scanning direction, of the grooves 22*a*. A common ink chamber 34, which extends in the nozzle-row direction and spreads over portions facing end portions of the pressure chambers 30 on an opposite side of the nozzles 20, is formed in the cover plate 23. Moreover, an ink supply port 35 which opens in a surface of the cover plate 23, on an opposite side of the piezoelectric plate 22, is provided in the common ink chamber 34. The tube 36 is connected to the ink supply port 35. The tube 36 is bent at a half-way and extends upward.

Here, a method of jetting an ink from the nozzle 20 by driving the ink-jet head 3 will be described below. In the ink-jet head 3, all the electrodes 32 are kept at a ground electric potential in advance by a driver IC 45 which will be described later. Moreover, at the time of making the ink jet from a certain nozzle 20, an electric potential of one of the two pairs of electrodes 32 formed on the wall portions 22*a* on both sides of the pressure chamber 30 corresponding to the nozzle 20 is let to be a positive electric potential by the driver IC 45. Accordingly, an electric potential difference is generated between the two pairs of electrodes 32, and an electric field in the nozzle-row direction is generated in the wall portion 22*b* sandwiched between these electrodes 32.

Here, each wall portion 22*b* being polarized in the scanning direction in advance, and a direction of the electric field being orthogonal to a direction of polarization, due to piezoelectric thickness glide effect, the wall portion 22*a* is deformed to form a projection toward the pressure chamber 30, and a volume of the pressure chamber 30 decreases. Accordingly, a pressure on the ink inside the pressure chamber 30 increases and the ink is jetted from the nozzle 20 communicating with the pressure chamber 30. In the present embodiment, a combination of the electrodes 32 and the wall portions 22*a* of the piezoelectric plate 22, for jetting the ink from the nozzle 20 by applying pressure to the ink inside the pressure chamber 30, corresponds to an actuator according to the present teaching.

Figure 3:
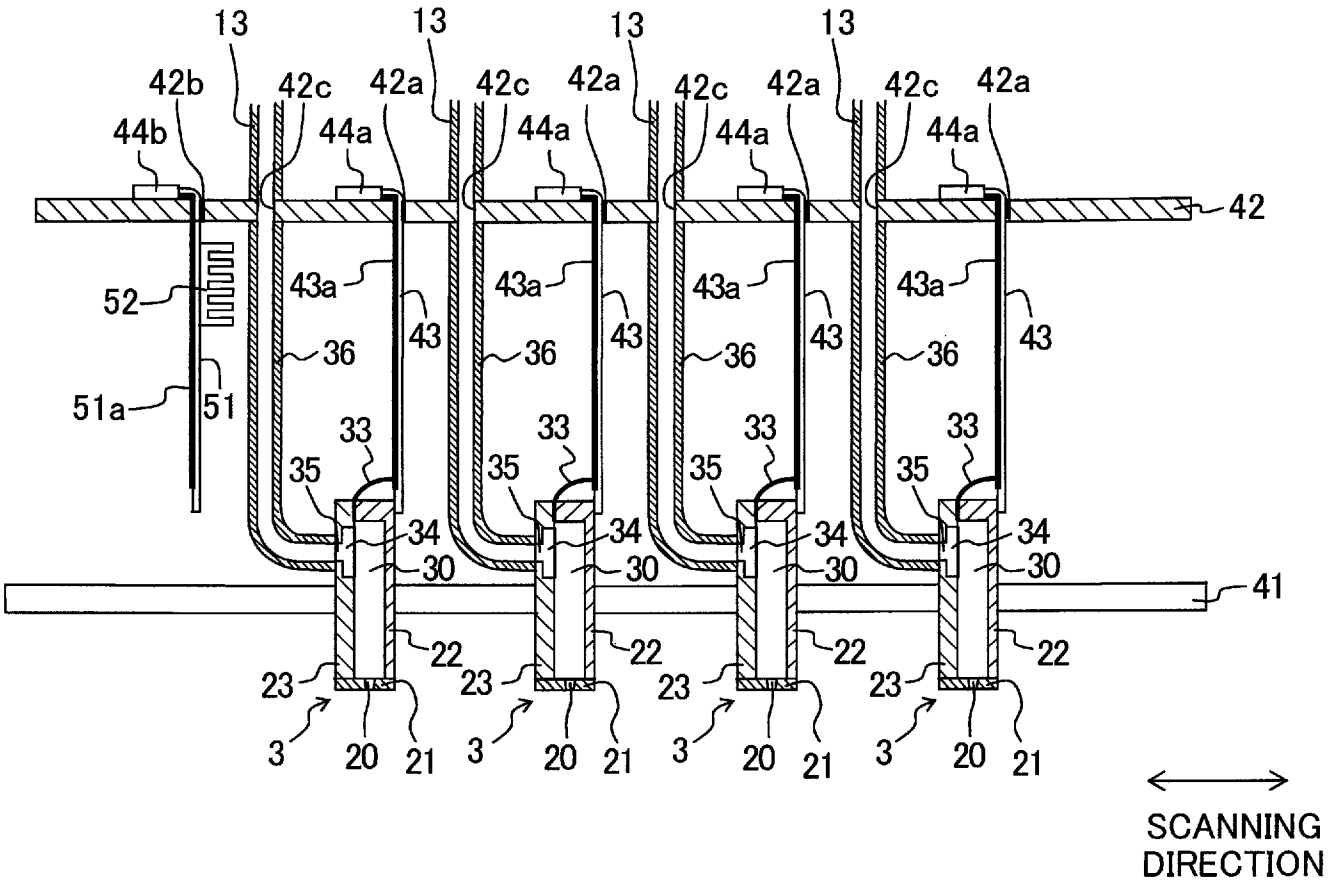
FIG. 3 is a cross-sectional view when a portion of the ink jet head on which nozzles are formed and a surrounding portion thereof are cut at a plane orthogonal to a nozzle-row direction.

Moreover, the ink jet head 3 having the structure described above is installed on an installing member 41 provided to the carriage 2, as shown in FIG. 3.

The four ink-jet heads 3 described above are connected to an interposer substrate 42 which is arranged above the four ink-jet heads 3, via an FPC (flexible printed circuit board) 43 (circuit board).

More elaborately, a lower-end portion of the FPC 43 is joined to a surface of the piezoelectric plate 22, on the opposite side of the cover plate 23 (right side in FIG. 3), and the wire 33 drawn from the electrode 32 is connected to a wire 43*a* formed on the FPC 43. Moreover, the FPC 43 extends upward from a connecting portion with the piezoelectric plate 22.

Figure 4:
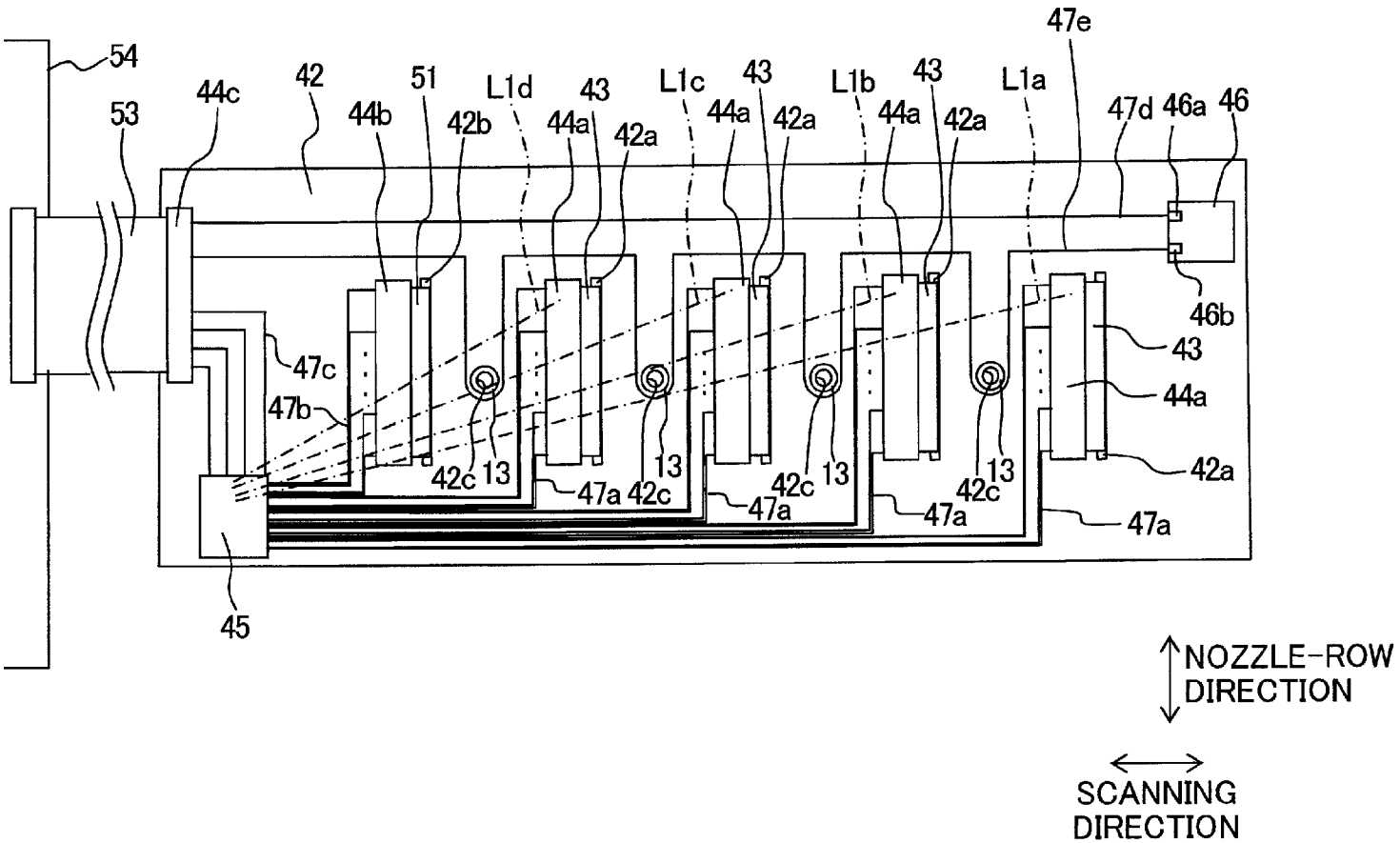
FIG. 4 is a plan view of an interposer substrate.

The interposer substrate 42, as shown in FIG. 3 and FIG. 4, is a flat substrate having a substantially rectangular shape in which four drawing holes 42*a*, a through hole 42*b*, and supply holes 42*c* are formed. By arranging the interposer substrate 42 above the four ink jet heads 3, a surface thereof is arranged to face the ink-jet heads 3. Moreover, the interposer substrate 42 includes connectors 44*a*, 44*b*, and 44*c* (hereinafter, "connectors 44*a* to 44*c*"), the driver IC 45, a thermistor 46, and wires 47*a*, 47*b*, 47*c*, 47*d*, and 47*e* (hereinafter, "wires 47*a* to 47*e*").

The four drawing holes 42*a* (drawing portions) are formed at portions of the interposer substrate 42, coinciding with four ink-jet heads 3 in a plan view, and are substantially rectangular-shaped through holes with the nozzle-row direction as a longitudinal direction, and which penetrate the interposer substrate 42 in a thickness direction of the interposer substrate 42. The four FPCs 43 which extend upward from the connecting portion with the four ink-jet heads 3 are drawn up to an upper side of the interposer substrate 42 through the drawing holes 42*a*. Moreover, the connector 44*a* (second connecting portion) is provided to a portion on an upper surface (one surface on the opposite side of the actuator) of the interposer substrate 42, on a left side immediately next to the drawing hole 42*a* in FIG. 3, and an upper-end portion of the FPC 43 is connected to the connector 44*a*.

The through hole 42*b* (penetrating portion) is a through hole having a substantially rectangular shape same as the drawing hole 42*a*. The through hole 42*b* is formed in a portion of the interposer substrate 42, on a further left side of the drawing hole 42*a* which is at the extreme left side in FIG. 3, and is side-by-side in the scanning direction of the four drawing holes 42*a*. The connector 44*b* is provided to a portion on a surface of the interposer substrate 42, on a left side immediately next to the through hole 42*b* in FIG. 3, and an upper end portion of a dummy FPC 51 (dummy substrate) on one surface of which a wire 51*a* is formed is connected to the connector 44*b*. The dummy FPC 51 is a substrate which is flexible similar to the FPC 43, and is hanging downward from the interposer substrate 42 through the through hole 42*b*. In other words, the dummy FPC 51 is drawn to an upper surface of the interposer substrate 42 through the through hole 42*b*. Moreover, the dummy FPC 51 does not make a contact with the ink-jet head 3. Furthermore, a heat sink 52 is provided on a surface of the dummy FPC 51. Moreover, a plurality of soldering balls are formed on the wire 51*a* (wiring pattern) of the dummy FPC 51 for widening a surface area of the wire and discharging heat efficiently. A structure for widening the surface area of the wire 51*a* of the dummy FPC 51 is not restricted to the soldering balls, and may be metal balls for instance.

The supply holes 42*c* are through holes having substantially circular shape with a diameter almost same as an inner diameter of the tube 13 and the tube 36, which are provided between the adjacent drawing holes 42*a*, and between the through hole 42*b* and the drawing hole 42*a* on the extreme left side in FIG. 4. An end portion on a side opposite to the ink cartridge 4 of the tube 13, which is connected to the ink cartridge 4, is connected to the supply hole 42*c* from above, and an end portion on a side opposite to the ink supply port 35 of the tube 36, which extends upward from a connecting portion with the ink supply port 35 is connected to the supply hole 42*c* from below. Accordingly, an ink in the ink cartridge 4 is supplied to the ink jet head 3 through the ink supply port 35 via the tube 13, the supply hole 42*c*, and the tube 36.

At this time, since the tube 13 and the tube 36 are let to be separate tubes, if two end portions of the tube 36 are connected to the ink supply port 35 and the supply hole 42*c* respectively and after that two end portions of the tube 13 are connected to the ink cartridge 4 and the supply hole 42*c* respectively before arranging the ink-jet head 3 and the interposer substrate 42 on the carriage, it possible to connect the tube 13 and the tube 36 easily.

The driver IC 45 is provided at a lower-left end portion of the interposer substrate 42 in FIG. 4, and is joined to the interposer substrate 42 via the soldering balls for example. A connector 44*c* (first connecting portion) is arranged at an upper-left end portion on an upper surface of the interposer substrate 42 in FIG. 4. Moreover, the driver IC 45 and the connector 44*c* are connected mutually via a plurality of wires 47*c*.

By the driver IC 45 and the connector 44*c* being arranged in such manner, the driver IC 45 is arranged at a position nearer to the connector 44*c* than the connector 44*b*. Moreover, the driver IC 45 being arranged in such manner, the through hole 42*b* is positioned on a line connecting the driver IC 45 and one of the connectors 44*a*. Here, the "line connecting the driver IC 45 and one of the connectors 44*a*" means any one of virtual lines which may be drawn by connecting any portion of the driver IC 45 and any portion of one of the connectors 44*a*. In FIG. 4, each of lines L1*a*, L1*b*, L1*c*, and L1*d* (hereinafter, "lines L1*a* to L1*d*") is shown as an example of the virtual lines.

Moreover, the driver IC 45 is connected to the four connectors 44*a* via the plurality of wires 47*a* respectively, and is also connected to the connector 44*b* via the plurality of wires 47*b*. On the other hand, a control substrate 54 is connected to the connector 44*c* via an FFC (flexible flat cable) 53 (wire member). Wires of the FFC 53 and the wires 47*c* include wires such as wires through which control signals for controlling an operation of the ink jet head 3 are transmitted, and a wire which becomes a power supply line. The control substrate 54 carries out transmission of control signals for controlling the operation of the ink jet head 3 and supply of driving electric power to the driver IC 45 via the FFC 53 and the wires 47*c*.

The driver IC 45 drives the ink-jet head 3 by generating driving signals for driving the ink jet head 3 based on the control signals transmitted from the control substrate 54, and transmitting the driving signals generated to the ink-jet head 3 (electrode 32) via the wires 47*a*, the connectors 44*a*, and the wires of the FPC 43. Here, the driving signal is transmitted from the driver IC 45 to the electrode 32 by LVDS (low voltage differential signaling). Accordingly, it is possible to reduce the number of wires 47*a*.

The thermistor 46 is mounted on an upper-right end portion in FIG. 4 of the upper surface of the interposer substrate 42. Accordingly, the abovementioned driver IC 45 and the thermistor 46 are arranged at portions positioned on opposite corners of the substantially rectangular-shaped interposer substrate 42, and the abovementioned drawing holes 42*a* and the through hole 42*b* are arranged between the driver IC 45 and the thermistor 46. The thermistor 46 has two terminals 46*a* and 46*b*, and is an element for which a resistance value between the terminals 46*a* and 46*b* changes substantially according to a change in temperature. In other words, a voltage between the two terminals 46*a* and 46*b* becomes a voltage corresponding to a temperature of the thermistor 46.

The two terminals 46*a* and 46*b* are connected to the connector 44*c* via the wires 47*d* and 47*e* respectively, formed on the upper surface of the interposer substrate 42, and accordingly, are connected to the control substrate 54 via the FFC 53. The control substrate 54 detects the temperature of the thermistor 46 from the voltage between the terminals 46*a* and 46*b*, and compensates the control signal to be transmitted to the driver IC 45, based on the temperature which has been detected.

The wires 47*d* and 47*e* are drawn from the connector 47*c*, and extend rightward in FIG. 4 from a connecting portion with the connector 44*c* toward the terminals 46*a* and 46*b*. However, the wire 47*d* extends in almost a straight line toward the terminal 46*a* whereas the wire 47*e* (wiring pattern) is bent between the four drawing holes 42*a*, and between the through hole 42*b* and the drawing hole 42*a* at the extreme left side in FIG. 4, and is drawn around to surround an area around the supply holes 42*c*. Accordingly, a heat of the ink flowing through the supply holes 42*c* is susceptible to be transmitted to the thermistor 46 via the wire 47*e*.

According to the present embodiment which has been described above, since the driver IC 45 is arranged at the position nearer to the connector 44*c* than the connector 44*a*, a substantial heat which is generated in the driver IC 45 is transmitted more toward the FFC 53 than toward the FPC 43. Moreover, since the through hole 42*b* is formed in the interposer substrate 42, the heat which is generated in the driver IC 45 is escaped from the interposer substrate 42 while being transmitted by circumventing the surrounding of the through hole 42*b*, and is hardly transmitted to the FPC 43 and the ink-jet head 3. Accordingly, it is possible to reduce an effect of the heat of the driver IC 45 on an amount of jetting of ink from the nozzles 20 in the ink-jet head 3.

Furthermore, since the heat which is generated in the driver IC 45 is transmitted to the dummy FPC 51 which is hanging downward from the through hole 42*b*, and is escaped from the dummy FPC 51, the heat is hardly transmitted to the FPC 43 and the ink jet head 3. Moreover, since the wire 51*a* of the dummy FPC 51 and the driver IC 45 are connected via the wire 47*b*, the heat is susceptible to be transmitted from the driver IC 45 to the dummy FPC 51, and it is possible to improve heat release efficiency in the dummy FPC 51. Moreover, since the dummy FPC 51 is not in contact with the ink-jet head 3, it is possible to prevent the heat transmitted to the dummy FPC 51 from being transmitted to the ink jet head 3.

Moreover, in this case, since the heat sink 52 is mounted on the dummy FPC 51, it is possible to improve further the heat release efficiency in the dummy FPC 51, and also there is no need to provide a space for mounting the heat sink 52 on the interposer substrate 42. Consequently, it is possible to let the heat generated in the driver IC 45 escape while making size of the interposer substrate 42 small.

Moreover, in the present embodiment, since the driver IC 45 is fixed to the interposer substrate 54 via the soldering balls and also the plurality of soldering balls are formed on the wire 51*a* of the dummy FPC 51, the heat generated in the driver IC 45 escapes also from surface of the soldering balls, and the heat release efficiency is improved further. Since a rise in the heat release efficiency due to the forming of the soldering balls is not so substantial, the driver IC 45 may be fixed to the interposer substrate 42 directly and not via the soldering balls, or the soldering balls may not be formed on the wire 51*a*.

Moreover, in the present embodiment, inks of four different colors (yellow, cyan, magenta, and black) are jetted from the four ink jet heads 3. From among these inks of four colors, for the black ink which is dark in color, a change in color due to the change in temperature is substantial compared to an ink of a light color. Moreover, from among the color inks, for the yellow ink which has the lightest color, the change in color due to the change in temperature is small.

Therefore, in the present embodiment, the four ink jet heads 3 jet inks of yellow, cyan, magenta, and black in order from the left side in FIG. 1. From among the four ink-jet heads 3, the ink jet head 3 which jets the ink of yellow color is arranged at a position nearest from the driver IC 45 and also the ink jet head 3 which jets the ink of black color is arranged at a position farthest from the driver IC 45.

Consequently, from among the four ink jet heads 3, for the ink-jet head 3 which jets the black ink, the color of which changes substantially due to the change in temperature, there is hardly any temperature change due to the heat generated in the driver IC 45, and it is possible to suppress a degradation of printing quality due to the heat generated in the driver IC 45.

Moreover, in the present embodiment, since the four drawing holes 42*a* and the through hole 42*b* mentioned above are arranged between the driver IC 45 and the thermistor 46, the heat generated in the driver IC 45 is released while being transmitted to the thermistor 46 by circumventing the drawing hole 42*a* and the through hole 42*b*, and is hardly transmitted to the thermistor 46. Consequently, a resistance of the thermistor 46 hardly changes due to the effect of heat generated in the driver IC 45.

Furthermore, since the wire 47*e* which connects the thermistor 46 and the connector 44*c* is drawn around to pass over the surrounding of the supply holes 42*c*, the heat of the ink which flows through the supply holes 42*c* is susceptible to be transmitted up to the thermistor 46 via the wire 47*e*. Consequently, the resistance of the thermistor 46 becomes close to a resistance corresponding to the temperature of the ink. In other words, the voltage between the terminals 46*a* and 46*b* becomes closer to the voltage corresponding to the temperature of the ink. Accordingly, in the control substrate 54, the temperature of the thermistor 46 which is detected from the voltage between the terminals 46*a* and 46*b* becomes a temperature close to the actual temperature of the ink. Since the control signal transmitted from the control substrate 54 to the driver IC 45 is compensated according to the temperature of the thermistor 46 which is detected from the voltage between the terminals 46*a* and 46*b*, the control signal is corrected according to a viscosity of the ink which changes according to the temperature. Accordingly, a variation in jetting characteristics of the ink from the nozzles 20 due to the change in temperature is reduced, and it is possible to improve the printing quality.

Moreover, as it has been mentioned above, from among the four ink-jet heads 3, in a case in which the ink-jet head 3 which jets the ink of black color is arranged at the position farthest from the driver IC 45, the ink jet head 3 which jets the ink of black color is arranged at a position nearest to the thermistor 46. Consequently, the resistance of the thermistor 46 becomes close to a resistance corresponding to the temperature of the black ink. In other words, the voltage between the terminals 46*a* and 46*b* becomes close to a voltage corresponding to the temperature of the black ink. Accordingly, the temperature detected from the voltage between the terminals 46*a* and 46*b* becomes close to the temperature of the black ink, and a control signal transmitted from the control substrate 54 to the driver IC 45 is corrected according to the viscosity of the black ink which changes according to the temperature. Consequently, for the black ink, the color of which changes substantially due to the change in temperature, the variation of jetting characteristics from the nozzles 20 due to the temperature change is reduced effectively in particular, and it is possible to improve the printing quality.

Moreover, in the present embodiment, on the interposer substrate 42, since a distance between the connector 44*c* which is connected to the control substrate 54 and the driver IC 45 becomes short, it is possible to shorten a length of the wires 47*c* including the wire of the power supply line which connects the control substrate 54, the connector 44*c*, and the driver IC 45. On the other hand, since a distance between the driver IC 45 and the connector 44*a* becomes long, a space for drawing around of the wire 47*a* which connects the driver IC 45 and the connector 44*a* becomes large, and drawing around of the wire 47*a* becomes easy.

Since it is possible to draw the FPC 43 to the upper surface (side of the interposer substrate 42 opposite to the actuator) of the interposer substrate 42 through the drawing hole 42*a*, and to connect to the connector 44*a* provided on the upper surface of the interposer substrate 42, it is possible to shorten a length of the FPC 43 as compared to a case in which the FPC 43 is drawn to the upper surface of the interposer substrate 42 upon taking a roundabout path around a side surface of the interposer substrate 42. Consequently, it is possible to reduce a voltage drop of the driving signal which is transmitted from the driver IC 45 to the ink-jet head 3, and to suppress a degradation of a waveform of the driving signal.

Next, modified embodiments in which various modifications are made in the present embodiment will be described below. However, description of structures which are similar to the structures in the present embodiment will be omitted appropriately.

In the embodiment, the wire 47*e* which connects the thermistor 46 and the connector 44*c* is bent at a half-way and is drawn around to surround areas around the supply holes 42*c*. However, the wire 47*e*, similarly as the wire 47*d*, may extend in a straight line from the connecting portion with the connector 44*c* toward the terminal 46*b*.

Moreover, in the embodiment, the thermistor 46 is arranged so that all the four drawing holes 42*a* and the through hole 42*b* are sandwiched between the driver IC 45 and the thermistor 46. However, the arrangement is not restricted to such an arrangement, and the position of the thermistor 46 may be appropriately variable in a range of sandwiching at least one of the four drawing holes 42*a* and the through hole 42*b* between the driver IC 45 and the thermistor 46.

Moreover, in the embodiment, the thermistor 46 has been provided as a temperature sensor. However, a temperature sensor other than a thermistor, such as a thermoelectric couple and a semiconductor temperature sensor may be provided.

In the embodiment, the dummy FPC 51 has been provided to be hanging downward from the through hole 42*b*, and furthermore, the heat sink 52 has been provided to the surface of the dummy FPC 51. However, the arrangement is not restricted to such an arrangement.

For instance, when there is sufficient space for the interposer substrate 42, the heat sink 52 may make a contact with the surface of the interposer substrate 42 in addition to the dummy FPC 51. In this case, it is possible to improve further the heat release efficiency in the interposer substrate 42. Or, the heat sink 52 may not be provided on the surface of the dummy FPC 51.

Figure 7:
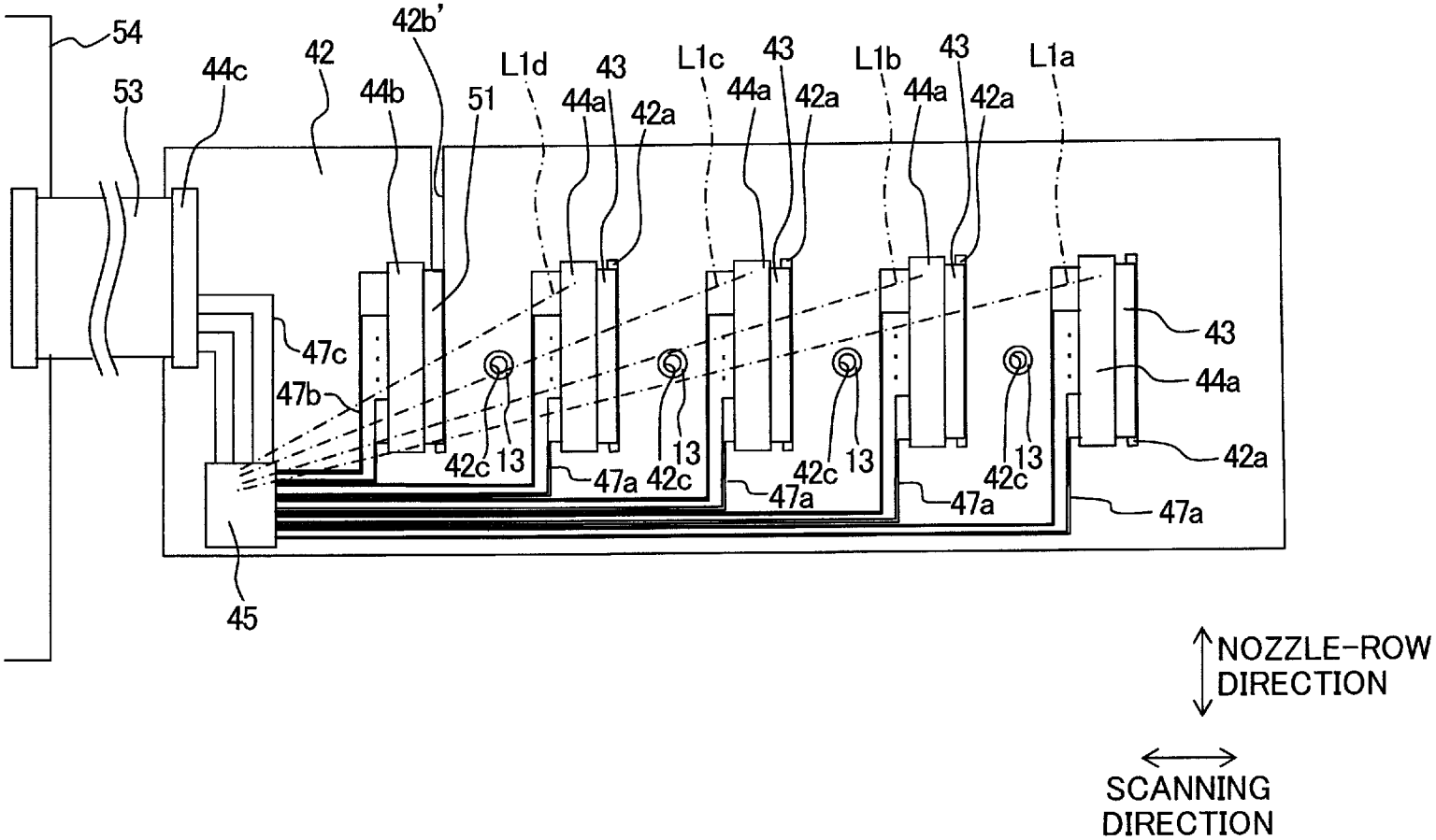
FIG. 7 is a diagram showing a modified embodiment of a through hole in the interposer substrate.

Moreover, an arrangement is not restricted to an arrangement with the through hole 42*b*. For instance, as shown in FIG. 7, a notch 42*b*' which penetrates the interposer substrate 42 in the thickness direction of the interposer substrate 42 and which opens on a side surface of the interposer substrate 42 may be formed instead of the through hole 42*b*. Furthermore, the notch 42*b*' is not restricted to a notch opening on the side surface of the interposer substrate 42, and may be a notch having a groove shape which opens on the upper surface (surface on a side where the connector 44*a* is arranged) of the interposer substrate 42. Moreover, the dummy FPC 51 which is hanging downward from the through hole 44*b* and the connector 44*b* for connecting the dummy FPC 51 may not be provided. In this case, the shape of the through hole 42*b* may be different from a shape of the drawing holes 42*a*.

Moreover, in the embodiment, the drawing holes 42*a* are formed in the interposer substrate 42, and the FPCs 43 extending upward from the connecting portion with the ink-jet head 3 are drawn on the upper surface of the interposer substrate 42 from the drawing hole 42*a*. However, the arrangement is not restricted to such an arrangement.

For instance, notches (drawing portion, penetrating notch) each of which penetrates the interposer substrate 42 in the thickness direction of the interposer substrate 42, and each of which opens on the side surface of the interposer substrate 42 may be formed instead of the drawing holes 42*a*, and the FPCs 43 may be drawn to the upper surface of the interposer substrate 42 through these notches.

Furthermore, when the through hole 42*b* is formed in the interposer substrate 42, the drawing portion for drawing the FPC 43 to the interposer substrate 42 is not restricted to be formed. For example, the FPC 43 may be extended to take a roundabout path around the side surface of the interposer substrate 42, and may be drawn to the upper surface of the interposer substrate 42. Or, the driver IC 45 and the connectors 44*a* to 44*c* may be arranged on a lower surface of the interposer substrate 42, and the FPCs 43 may be connected to the connectors 44*a* on the lower surface of the interposer substrate 42.

Moreover, in the embodiment, the driver IC 45 and the connector 44*c* are arranged on the lower-left end portion and the upper-left end portion in FIG. 4 of the interposer substrate 42 respectively, and the through hole 42*b* is arranged to be side-by-side in the scanning direction of the four through holes 42*a*. However, the arrangement is not restricted to such an arrangement. In the first modified embodiment, as shown in FIG. 5, the driver IC 45 is arranged at a substantially central portion of the interposer substrate 42, with respect to the scanning direction, and at the lower side in FIG. 5 of the four drawing holes 42*a*.

Figure 5:
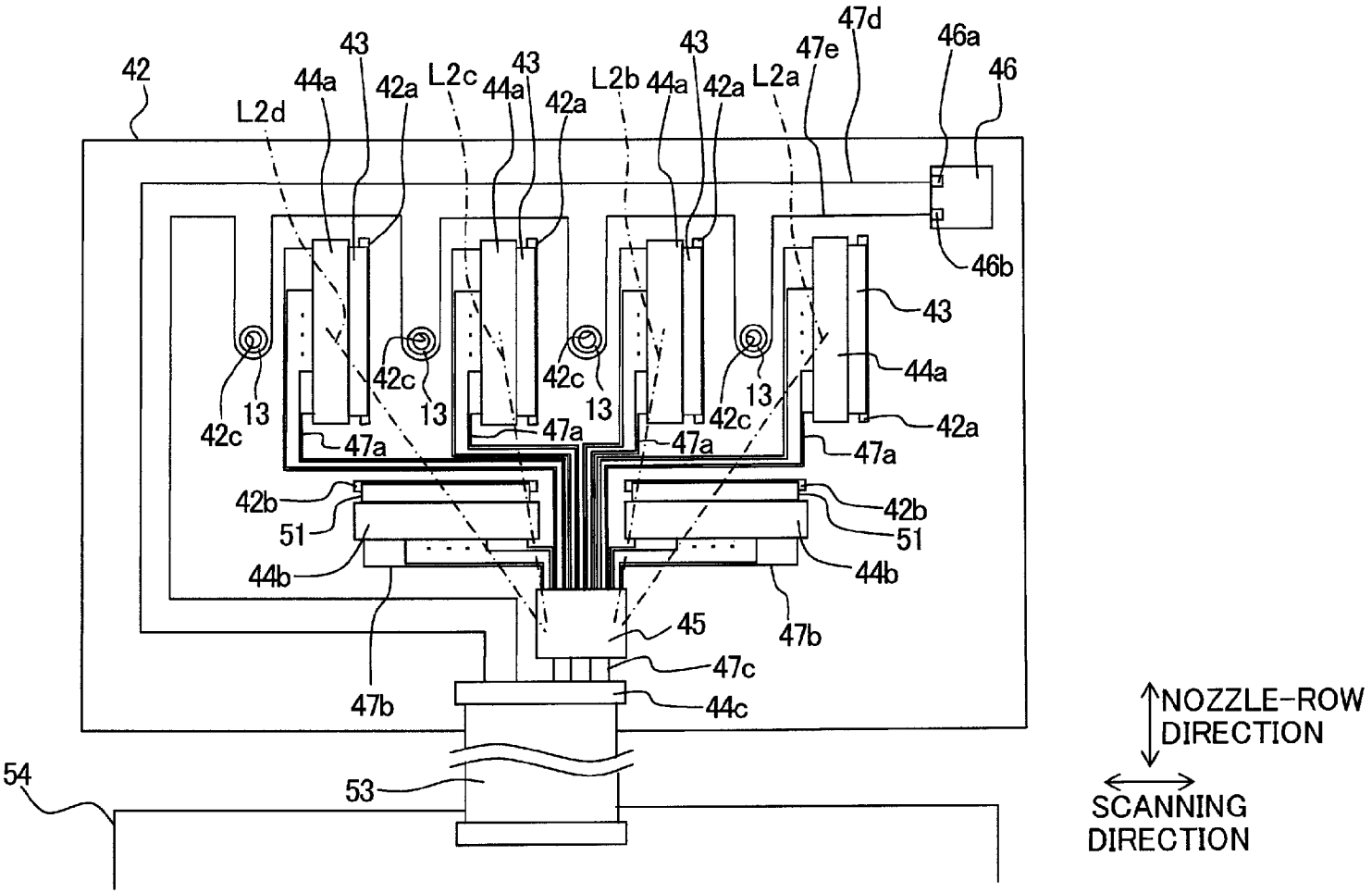
FIG. 5 is a diagram corresponding to FIG. 4, of a first modified embodiment.

Moreover, the connector 44*c* is provided to an immediate lower side of the driver IC 45 in FIG. 5, and accordingly, the driver IC 45 is arranged at a position nearer to the connector 44*c* than to the connectors 44*a*. Moreover, two through holes 42*b* are provided in an area positioned between the connectors 44*a* and the driver IC 45 with respect to the nozzle-row direction, and the connectors 44*b* and the dummy FPC 51 are provided for the two through holes 42*b* respectively. Here, the through holes 42*b* and the connectors 44*b* are similar as in the abovementioned embodiment, but are directed in directions different from the directions in the abovementioned embodiment, and are arranged in a direction such that the scanning direction is a longitudinal direction of the through holes 42*b* and the connectors 44*b*.

Accordingly, the through hole 42*b* on a right side in FIG. 5 out of the two through holes 42*b* is positioned on a line connecting the driver IC 45 and each of the two connectors 44*a* on the right side in FIG. 5, from among the four connectors 44*a*. Moreover, the through hole 42*b* on a left side in FIG. 5 out of the two through holes 42*b* is positioned on a line connecting the driver IC 45 and each of the two connectors 44*a* on the left side in FIG. 5, from among the four connectors 44*a*. Here, the line connecting the driver IC 45 and each of the connectors 44*a* means any one of virtual lines which may be drawn by connecting any portion of the driver IC 45 and any portion of each connector 44*a*. In FIG. 5, lines L2*a*, L2*b*, L2*c*, and L2*d* (hereinafter, "lines L2*a* to L2*d*") are shown as an example of the virtual lines.

Moreover, the drawing around of the wires 47*a* to 47*e* is changed appropriately according to positions of the driver IC 45, and the connectors 44*b* and 44*c*.

In a case of the embodiment, a difference in the length of the wire 47*a* which connects the driver IC 45 and the connector 44*a* (connector on the extreme right side in FIG. 4) which is farthest from driver IC 45 from among the four connectors 44*a* and the length of the wire 47*a* which connects the driver IC 45 and the connector 44*a* (connector on the extreme left side in FIG. 4) which is nearest to the driver IC 45 from among the four connectors 44*a* has become substantial. A variation in the length of the wires 47*a* which connect the driver IC 45 and the four connectors 44*a* has become substantial. Therefore, in a case of sending a driving signal at a high speed from the driver IC 45 to the ink-jet head 3, a substantial variation in timing for a printing signal to reach the electrode 32 occurs, and there is a possibility that there is an effect on the printing quality.

Whereas, in the first modified embodiment, a variation in the length of the wires 47*a* which connect the driver IC 45 and the four connectors 44*a* becomes smaller as compared to the case in the embodiment. Consequently, it is possible to suppress the variation in the timing at which the printing signal reaches the electrode 32.

Furthermore, positions of the driver IC 45, the connector 44*c*, and the through hole 42*b* are not restricted to the positions described above. The positions of the driver IC 45 and the connector 44*c* may be changed appropriately in a range in which the driver IC 45 is arranged at a position nearer to the connector 44*c* than the connectors 44*a*. Moreover, the position of the through hole 42*b* may be changed appropriately in a range in which the through hole 42*b* is positioned on a line connecting the driver IC 45 and the connectors 44*a*, or in other words, on any of the virtual lines which may be drawn by connecting any portion of the driver IC 45 and any portion of the connectors 44*a*. In the embodiment, the through hole

42*b* is formed between the driver IC 45 and the connector 44*a* which is arranged at the position nearest to the driver IC 45 (the fourth connector 44*a* from right in FIG. 4). However, the through hole 42*b* may be formed between the connector 44*a* which is nearest to the driver IC 45 and the connector 44*a* which is second nearest to the driver IC 45 (between the fourth connector 44*a* from right and the third connector 44*a* from right in FIG. 4). Or, the through hole 42*b* may be formed between the connector 44*a* which is second nearest to the driver IC 45 and the connector 44*a* which is third nearest to the driver IC 45 (between the third connector 44*a* from right and the second connector 44*a* from right in FIG. 4). The through hole 42*b* may be formed between the connector 44*a* which is third nearest from the driver IC 45 and the connector 44*a* which is fourth nearest from the driver IC 45 (between the second connector 44*a* from right and the first connector 44*a* from right in FIG. 4). Even in these cases, the heat generated in the driver IC 45 is hardly transmitted to the connector 44*a* which is arranged at the position farther from the through hole 42*b*, with respect to the driver IC 45. Therefore, it is possible to connect the ink-jet head 3 which jets ink which is susceptible to have an effect of heat, to the connector 44*a* which is arranged at the position farther from the through hole 42*b* with respect to the driver IC 45, via the FPC 43, and it is possible to connect the ink jet head 3 which jets ink which has hardly any effect of heat to the connector 44*a* which is arranged at the position nearer to the driver IC 45 than the through hole 4*b* with respect.

Figure 6:
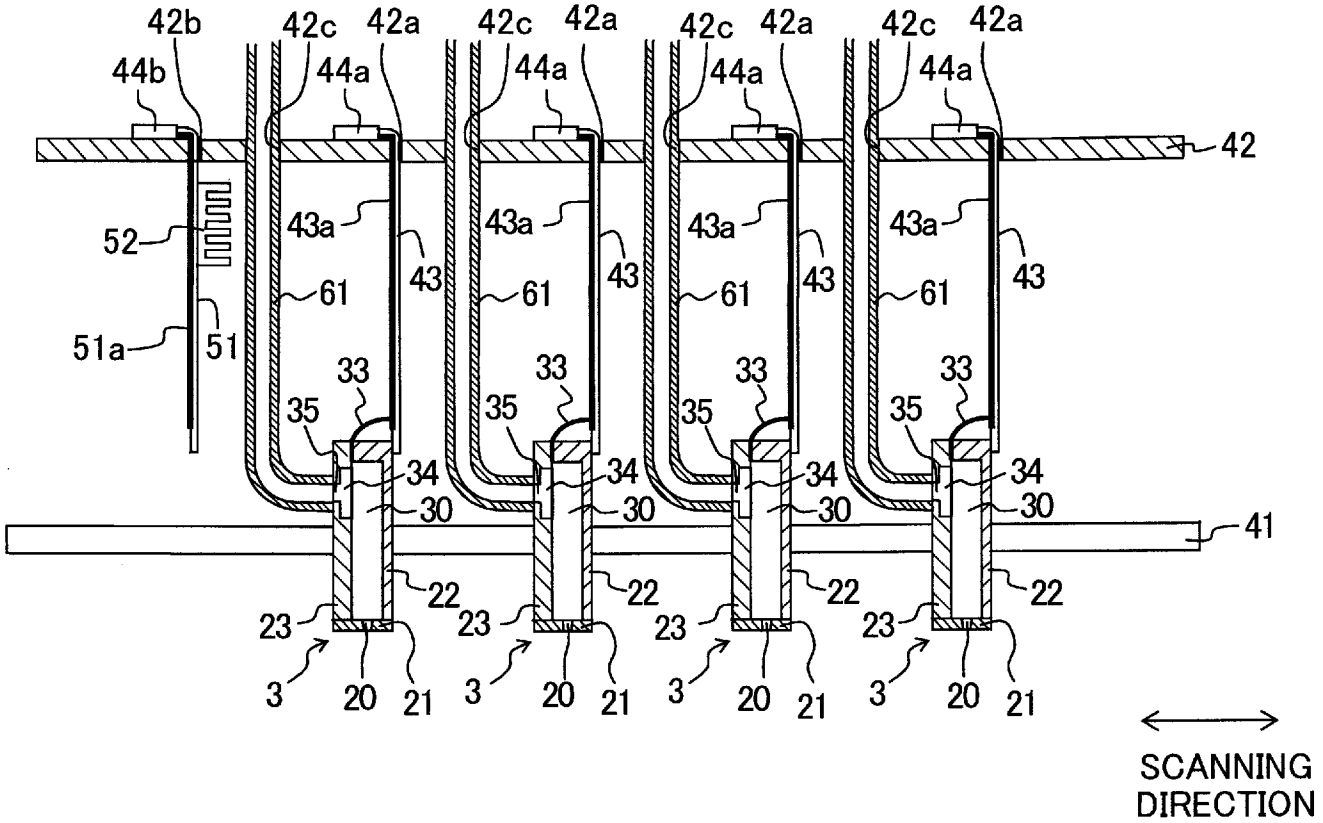
FIG. 6 is a diagram corresponding to FIG. 3, of a second modified embodiment.

Moreover, in the embodiment, the tube 13 which is to be connected to the ink cartridge 4 and the tube 36 which is to be connected to the ink supply port 35 are separate tubes, and each of the tube 13 and the tube 36 is connected to the supply hole 42*c*. However, the arrangement is not restricted to such an arrangement. In another modified embodiment (a second modified embodiment), tubes 61 which are inserted through the supply ports 42*c* are provided instead of the tubes 13 and the tubes 36 as shown in FIG. 6. Moreover, two end portions of each of the tubes 61 are connected to the ink cartridge 4 (refer to FIG. 1) and the ink supply port 35 respectively.

In this case, since it is not necessary to provide separately a tube to be connected to the ink cartridge 4 and a tube to be connected to the ink supply port 35, it is possible to reduce the number of components.

Figure 8:
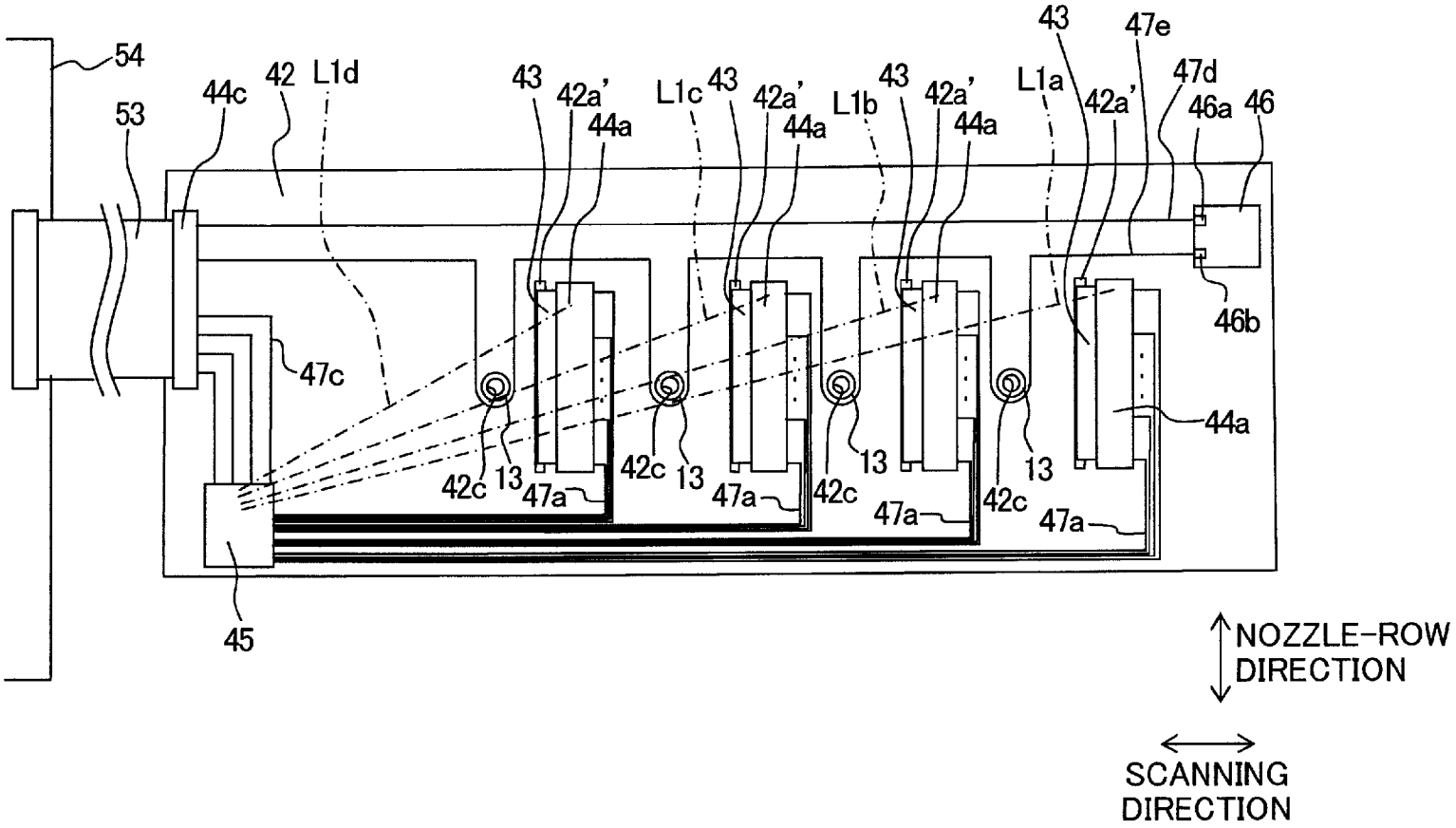
FIG. 8 is a diagram corresponding to FIG. 4, of a third modified embodiment.

Moreover, in the embodiment, each drawing hole 42*a* is formed on a side farther from each connector 44*a* (right side in FIG. 4) with respect to the driver IC 45. However, each drawing hole 42*a*' may be formed on a side nearer to the driver IC 45 than each connector 44*a* (left side in FIG. 8), with respect, as shown in FIG. 8 (third modified embodiment). Here, it is preferable to connect each wire 47*a* to each connector 44*a* on the side farther from the connector 44*a* (right side in FIG. 8) with respect to the driver IC 45. Even in this case, since each drawing hole 42*a*' is formed on virtual lines L1*a* to L1*d* which connect the driver IC 45 and each connector 44*a*, it is possible to achieve the heat release effect similar as in the embodiment. In this case, since the heat release effect is achieved by each drawing hole 42*a*', the through hole 42*b*, the dummy FPC 51 which is hanging downward from the through hole 42*b*, and the connector 44*b* for connecting the dummy FPC 51 may not be provided.

Moreover, in the embodiment, the present invention is applied to the ink jet printer which includes the ink-jet heads 3 by jetting the inks from the nozzles 20 upon increasing the pressure of the ink inside the pressure chambers 30, by deforming the wall portion 22*b* by the piezoelectric thickness glide effect. However, without restricting to such application, it is also possible to apply the present invention to an ink jet printer which includes an ink jet head which jets ink from nozzles by applying a pressure to the ink inside the pressure chamber by some other effect of a piezoelectric element, or an ink-jet head which jets ink from nozzles by an actuator which does not use a piezoelectric element. Moreover, in the embodiment, the printer includes four ink-jet heads 3. However, the number of ink-jet heads is not restricted to four.

Moreover, in the description made above, an example in which the present invention is applied to the ink jet printer which carries out printing by jetting the ink from the nozzles has been described. However, the application of the present invention is not restricted to the ink jet printer, and the present invention is also applicable to a liquid jetting apparatus other than the ink-jet printer.

What is claimed is:

1. A liquid jetting apparatus which jets a liquid, comprising:

a liquid jetting head in which nozzles for jetting the liquid are formed and which has an actuator for jetting the liquid from the nozzles;

an interposer substrate which is provided to the liquid jetting head and on which a driver IC is mounted;

a control substrate which controls the liquid jetting head;

a wire member which connects the interposer substrate and the control substrate; and a flexible circuit board which connects the interposer substrate and the actuator, wherein the interposer substrate has a first connecting portion to which the wire member is to be connected, and a second connecting portion to which the flexible circuit board is to be connected, the driver IC is arranged nearer to the first connecting portion than the second connecting portion of the interposer substrate, and a penetrating portion which penetrates the interposer substrate in a thickness direction of the interposer substrate or a notch is formed in the interposer substrate, so that the penetrating portion or the notch is arranged on a virtual line which is drawn by connecting any portion of the driver IC and any portion of the second connecting portion.

2. The liquid jetting apparatus according to claim 1, wherein the interposer substrate is arranged to be opposed to the actuator and has a drawing portion which is a through hole or a penetrating notch penetrating the interposer substrate in the thickness direction of the interposer substrate, the driver IC is mounted on a surface of the interposer substrate on a side opposite to the actuator, the second connecting portion is arranged on the surface of the interposer substrate, and the flexible circuit board is connected to the actuator, and is connected to the second connecting portion upon being drawn on the surface of the interposer substrate through the drawing portion.

3. The liquid jetting apparatus according to claim 2, further comprising a dummy substrate to which the interposer substrate is connected, which is drawn on the surface of the interposer substrate via the penetrating portion or the notch, which does not make a contact with the actuator, and which has a wiring pattern which is connected to the driver IC.

4. The liquid jetting apparatus according to claim 3, wherein the penetrating portion or the notch has a same shape as a shape of the drawing portion.

5. The liquid jetting apparatus according to claim 3, further comprising a heat sink which is mounted on the dummy substrate.

6. The liquid jetting apparatus according to claim 2, further comprising a temperature sensor which is mounted on the interposer substrate so that at least one of the penetrating portion and the drawing portion or at least one of the notch and the drawing portion is sandwiched between the temperature sensor and the driver IC.

7. The liquid jetting apparatus according to claim 6, wherein the temperature sensor is a thermistor having two terminals, the interposer substrate is further formed with a supply hole and a wiring pattern, the supply hole is formed to penetrate the interposer substrate in the thickness direction of the interposer substrate so that the supply hole communicates with a tube for supplying the liquid to the liquid jetting head or the tube is inserted into the supply hole; and the wiring pattern is drawn from the first connecting portion, on the surface of the interposer substrate, and is drawn up to a position at which one of the two terminals of the thermistor is arranged so that the wiring pattern surrounds the supply hole.

8. The liquid jetting apparatus according to claim 1, wherein the flexible circuit board connects the second connecting portion of the interposer substrate and the actuator through the penetrating portion or the notch.

9. The liquid jetting apparatus according to claim 8, wherein the penetrating portion or the notch is formed nearer to the second connecting portion of the interposer substrate than the driver IC.

* * * * *